US006925913B2

(12) United States Patent
Chen

(10) Patent No.: US 6,925,913 B2
(45) Date of Patent: Aug. 9, 2005

(54) SELECTIVE ONE-WAY WRENCH

(76) Inventor: Terence Chen, No. 325, Yung Ching Road, Tung Shan Hsiang, Lo Tung Town, Yi Lan Hsien (TW)

( * ) Notice: Subject to any disclaimer, the term of this patent is extended or adjusted under 35 U.S.C. 154(b) by 0 days.

(21) Appl. No.: 10/760,675

(22) Filed: Jan. 21, 2004

(65) Prior Publication Data

US 2005/0126347 A1 Jun. 16, 2005

(30) Foreign Application Priority Data

Dec. 11, 2003 (TW) ..... 92134964 A

(51) Int. Cl.[7] ..... B25B 13/46

(52) U.S. Cl. ..... 81/63.2; 192/43.2

(58) Field of Search ..... 81/63, 63.2; 192/43.2

(56) References Cited

U.S. PATENT DOCUMENTS

2003/0196522 A1 * 10/2003 Hu ..... 81/63.2

* cited by examiner

*Primary Examiner*—James G. Smith
(74) *Attorney, Agent, or Firm*—Birch, Stewart, Kolasch & Birch, LLP

(57) ABSTRACT

A selective one-way wrench includes an annular head defining a first space, a second space communicated with the first space and an aperture communicated with the second space. A gear is rotationally put in the first space and includes a toothed face. A pawl is put in the second space and includes a toothed face engaged with the toothed face of the gear and two concave faces. A transmission is rotationally put in the second space and includes two wings selective one of which is in contact with corresponding one of the concave faces of the pawl. A switch is put into the second space through the aperture for connection with the transmission. A spring is connected between the pawl and the transmission.

18 Claims, 10 Drawing Sheets

SELECTIVE ONE-WAY WRENCH

This Nonprovisional application claims priority under 35 U.S.C. § 119(a) on Patent Application No(s). 92134964 filed in TAIWAN on Dec. 11, 2003, the entire contents of which are hereby incorporated by reference.

FIELD OF INVENTION

The present invention relates to a selective one-way wrench.

BACKGROUND OF INVENTION

Referring to FIG. 10, a conventional selective one-way wrench 110 includes a handle 114, an annular head 115, an annular gear 120, a pawl 130 and a switch 140. The annular head 115 is formed at an end of the handle 114, the annular head 115 defines a first space 111, a second space 112 communicated with the first space 111 and a third space 113 communicated with the second space 112. The annular gear 120 is rotationally put in the first space 111. The annular gear 120 includes a toothed external face 121 formed thereon and a toothed internal face 122 for engagement with a bolt or nut. The pawl 130 is put in the second space 112. The pawl 130 includes a toothed face 131 formed thereon. The switch 140 is rotationally put in the third space 113 of the handle 114 and partially put in the second space 112 for bringing the toothed face 131 of the pawl 130 into engagement with the toothed external face 121 of the annular gear 120.

SUMMARY OF INVENTION

The primary objective of the present invention is to provide a selective one-way wrench.

A selective one-way wrench includes an annular head defining a first space, a second space communicated with the first space and an aperture communicated with the second space. A gear is rotationally put in the first space and includes a toothed face. A pawl is put in the second space and includes a toothed face engaged with the toothed face of the gear and two concave faces. A transmission is rotationally put in the second space and includes two wings selective one of which is in contact with corresponding one of the concave faces of the pawl. A switch is put into the second space through the aperture for connection with the transmission. A spring is connected between the pawl and the transmission.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings.

DETAILED DESCRIPTION OF EMBODIMENTS

Figure 1:
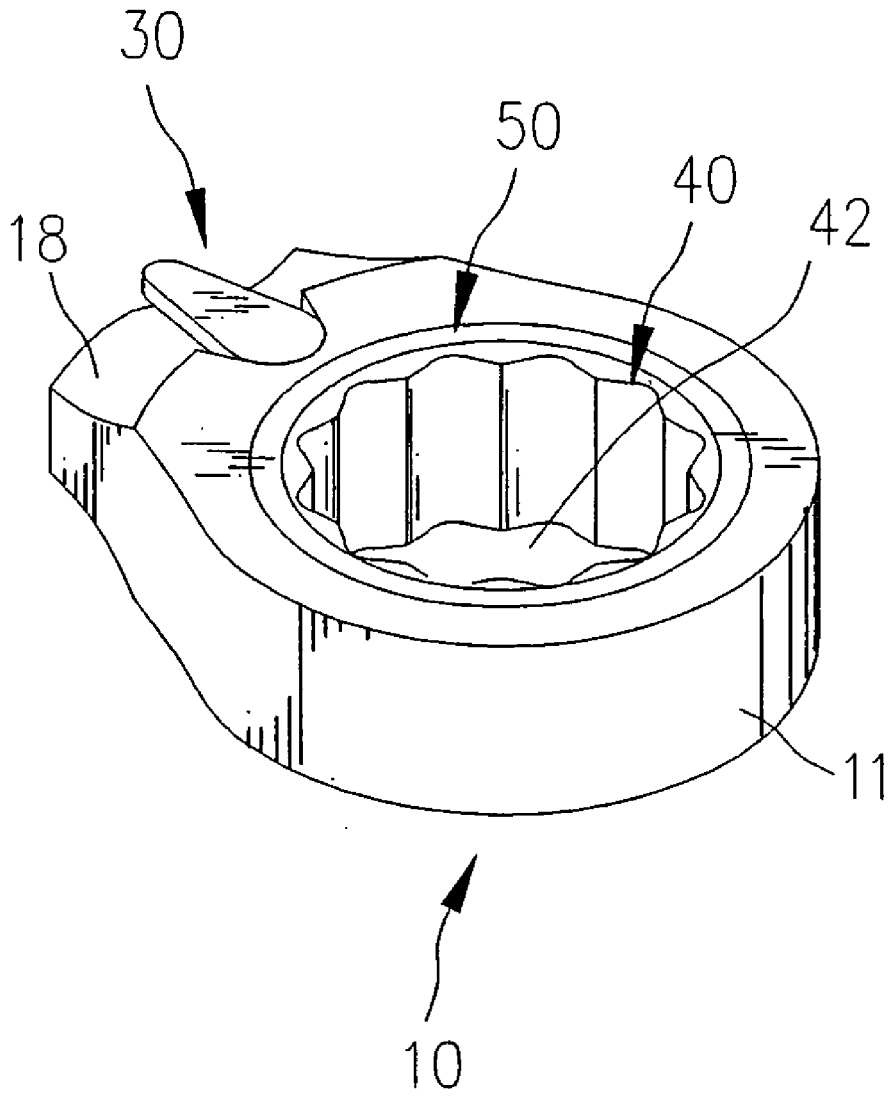
FIG. 1 is a perspective view of a selective one-way wrench according to a first embodiment of the present invention.

Referring to FIG. 1, according to a first embodiment of the present invention, a selective one-way wrench 10 includes a handle 18 and an annular head 11 from which the handle 18 projects.

Figure 2:
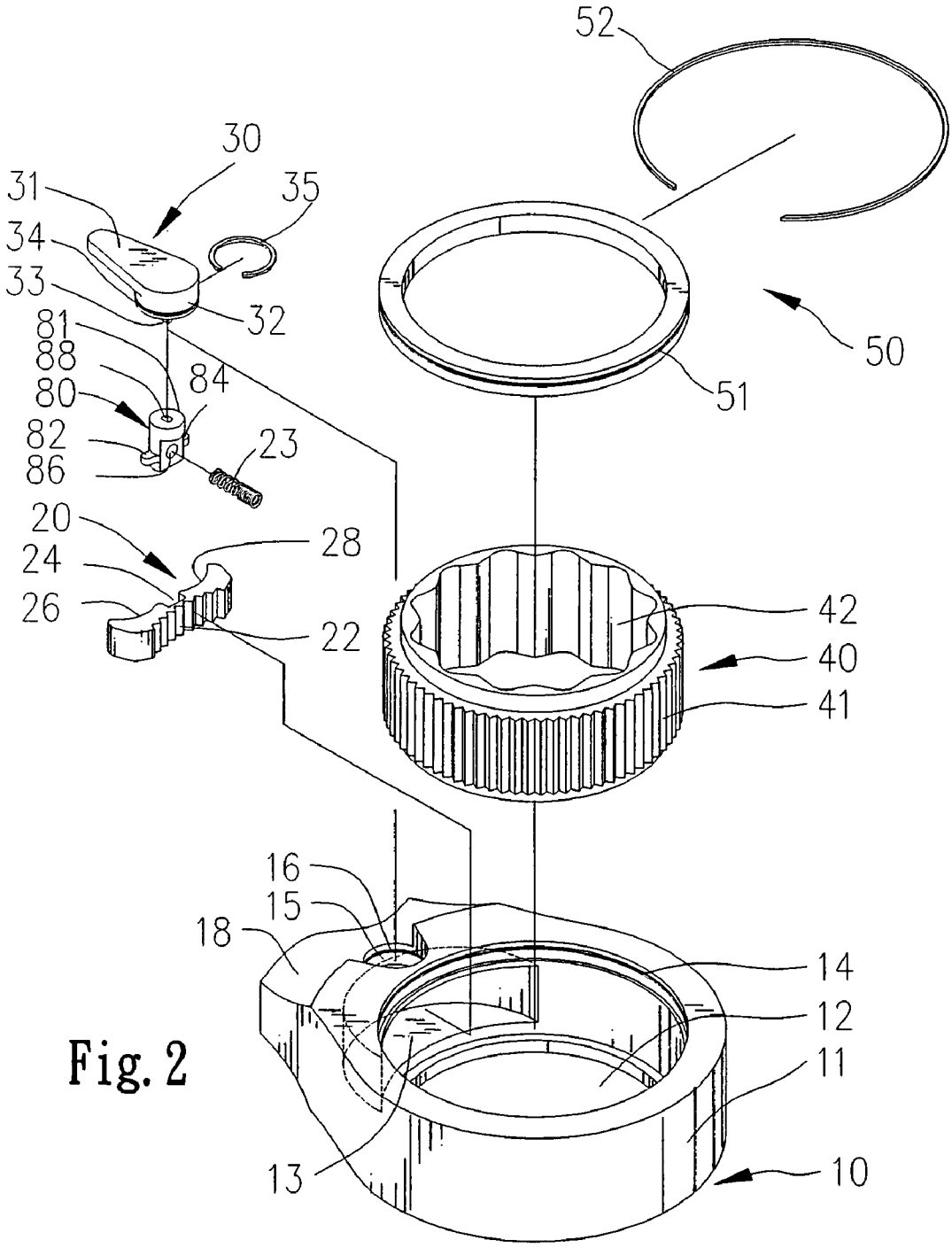
FIG. 2 is an exploded view of the selective one-way wrench shown in FIG. 1.

Referring to FIG. 2, the annular head 11 includes a circular space 12, a crescent space 13 communicated with the circular space 12 and an aperture 15 communicated with the crescent space 13. An annular groove 14 is defined in a wall of the circular space 12. An annular groove 16 is defined in a wall of the aperture 15.

A pawl 20 is put in the crescent space 13. The pawl 21 includes a first side and a second side opposite to the first side. A toothed face 22 is formed on the first side of the pawl 21. A recess 24 and two concave faces 26 and 28 are defined in the second side. The recess 24 is located between the concave faces 26 and 28.

A transmission 80 is put in the crescent space 13 before the pawl 20. The transmission 80 includes a rod 81 and two wings 82 and 84 both extending laterally from the rod 81. The rod 81 includes a recess 88 defined in a top and a hole 86 defined in a side.

A spring 23 includes an end put in the recess 24 of the pawl 20 and an opposite end 25 inserted in the hole 86 of the transmission 80.

An annular gear 40 is put in the circular space 12. The annular gear 40 includes a toothed external face 41 for engagement with the pawl 20 and a toothed internal face 42 for engagement with a bolt or nut.

An O-ring 50 is rotationally put on the annular gear 40. The O-ring 50 is put in the circular space 12. The O-ring 50 includes an annular groove 51 defined in an external face thereof. A C-ring 52 includes an internal edge put in the annular groove 51 and an external edge put in the annular groove 14. Thus, the O-ring 50 is firmly attached to the annular head 11 by means of the C-ring 52.

A switch 30 is put in the aperture 15. The switch 30 includes a lever 31, a shaft 32 extending from the lever 31, a tongue 33 extending from the shaft 32 and an annular groove 34 defined in the shaft 32. The tongue 33 is inserted into the recess 88 through the aperture 15. The switch 30 can drive the transmission 80 so that the wing 82 or 84 is engaged with the concave face 26 or 28 of the pawl 20.

A C-ring 35 includes an internal edge put in the groove 34 and an external edge put in the annular groove 16. Thus, the switch 30 is firmly attached to the annular head 11 by means of the C-ring 35.

Figure 3:
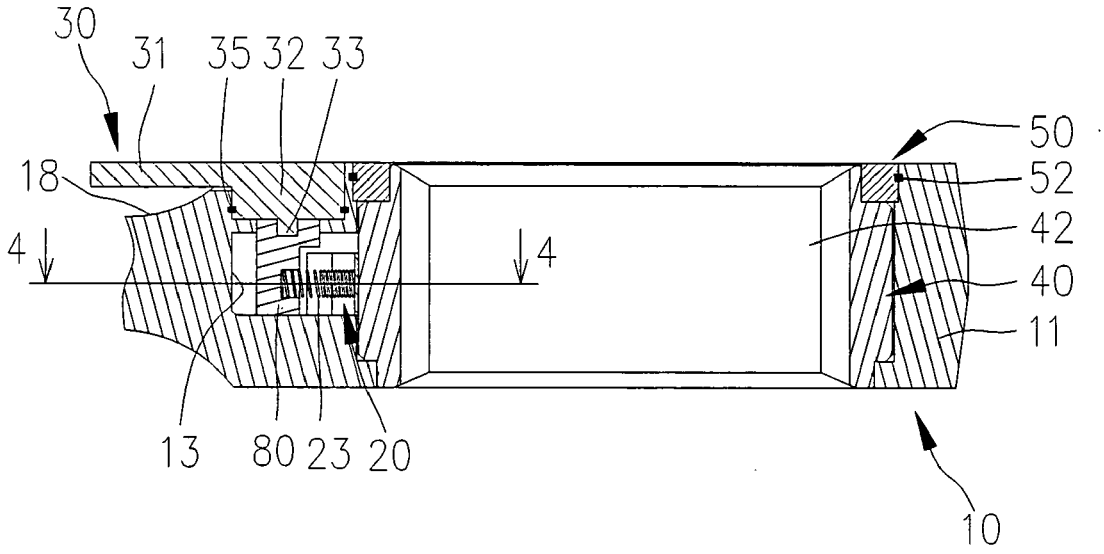
FIG. 3 is a cross-sectional view of the selective one-way wrench of FIG. 1.
Figure 4:
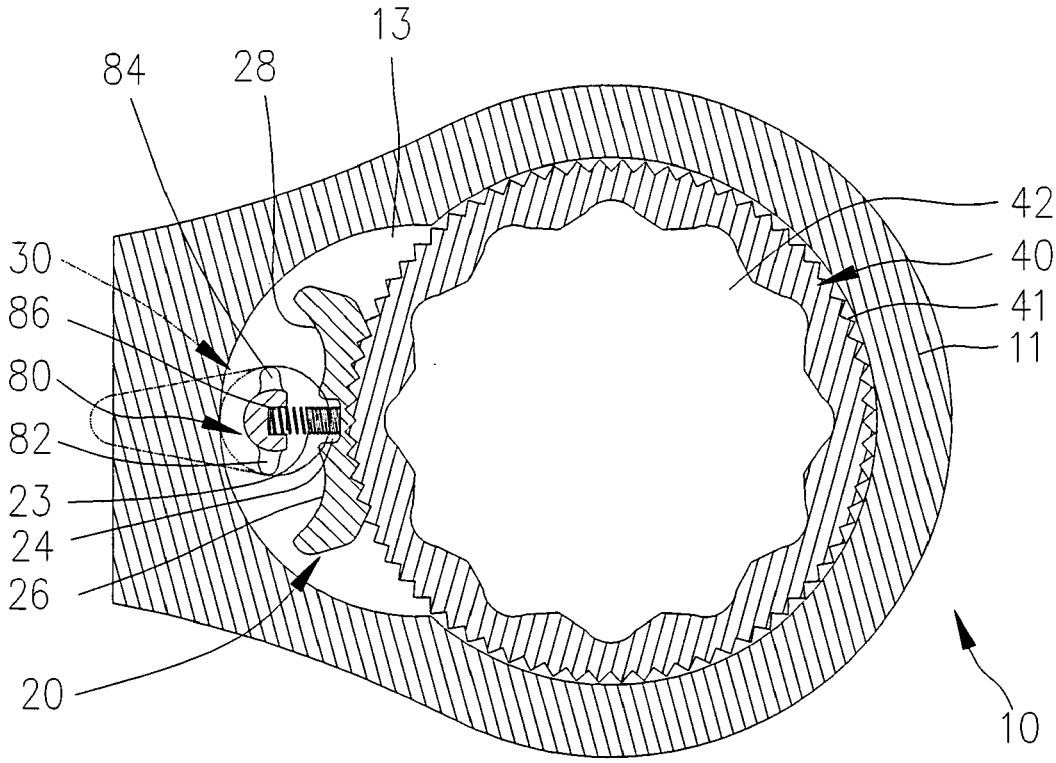
FIG. 4 is a cross-sectional view taken along a line 4—4 in FIG. 3.

Referring to FIGS. 3 and 4, the switch 30 is in a neutral mode. The spring 23 is put the recess 24 of the pawl 20. The wings 82 and 84 of the transmission 80 disengage from the pawl 20 so as to keep the switch 30 in the neutral mode.

Figure 5:
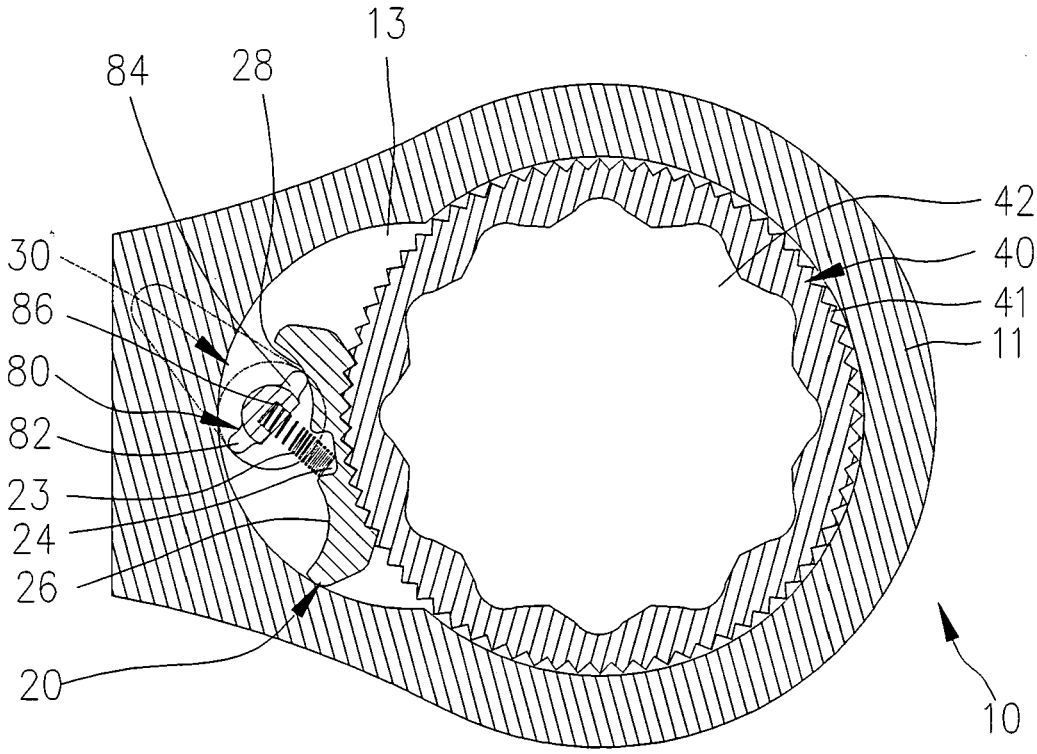
FIG. 5 is similar to FIG. 4 but shows the selective one-way wrench in a position for driving a bolt or nut clockwise.

Referring to FIG. 5, the switch 30 is moved to a first working mode. The switch 30 is rotated clockwise. The transmission 80 is moved accordingly. The pawl 20 is moved into left-hand end of the crescent space 13 by means of the spring 23. Thus, the wing 84 of the transmission 80 abuts the concave face 28 of the pawl 20. The annular head 11 can drive the annular gear 40 clockwise, but not vice versa.

Although not shown, the switch 30 can be moved to a second working mode. The switch 30 is rotated counter-clockwise. The transmission 80 is moved accordingly. The pawl 20 is moved into right-hand end of the crescent space 13 by means of the spring 23. Thus, the wing 82: of the transmission 80 abuts the concave face 26 of the pawl 20. The annular head 11 can drive the annular gear 40 counter-clockwise, but not vice versa.

Figure 6:
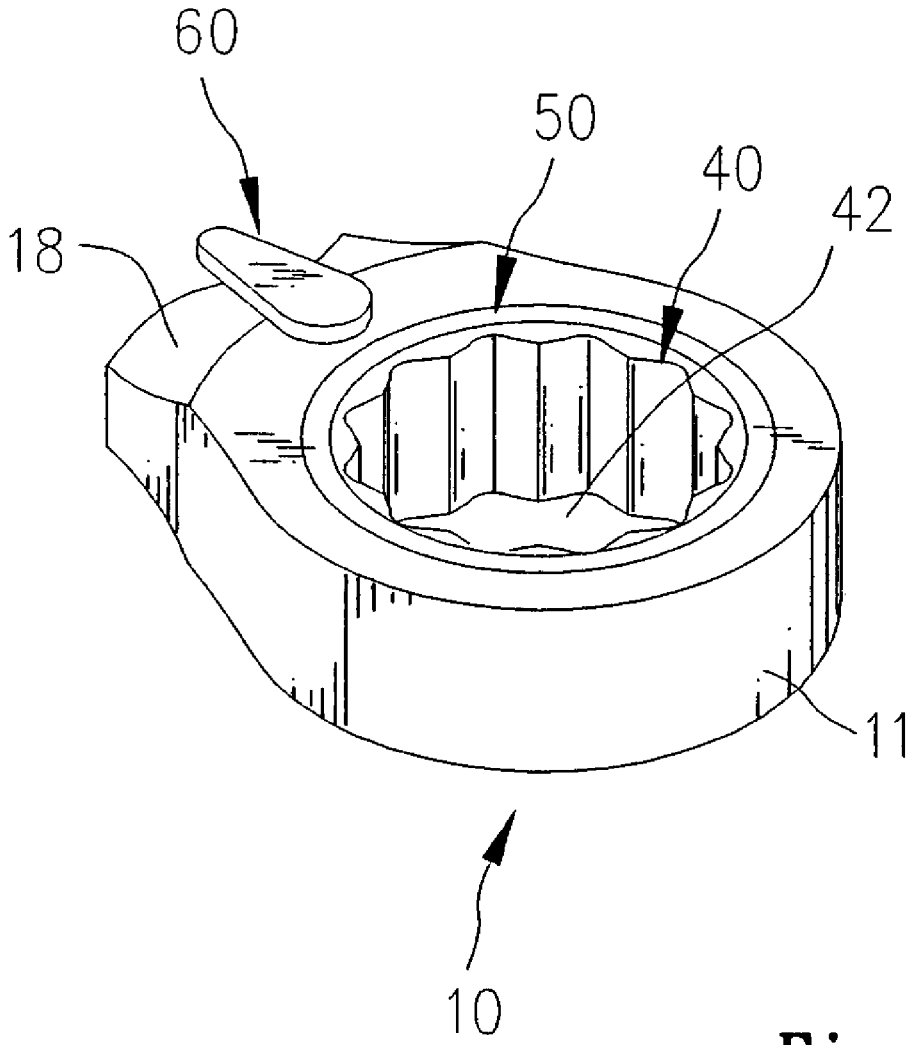
FIG. 6 is a perspective view of a selective one-way wrench according to a second embodiment of the present invention.
Figure 7:
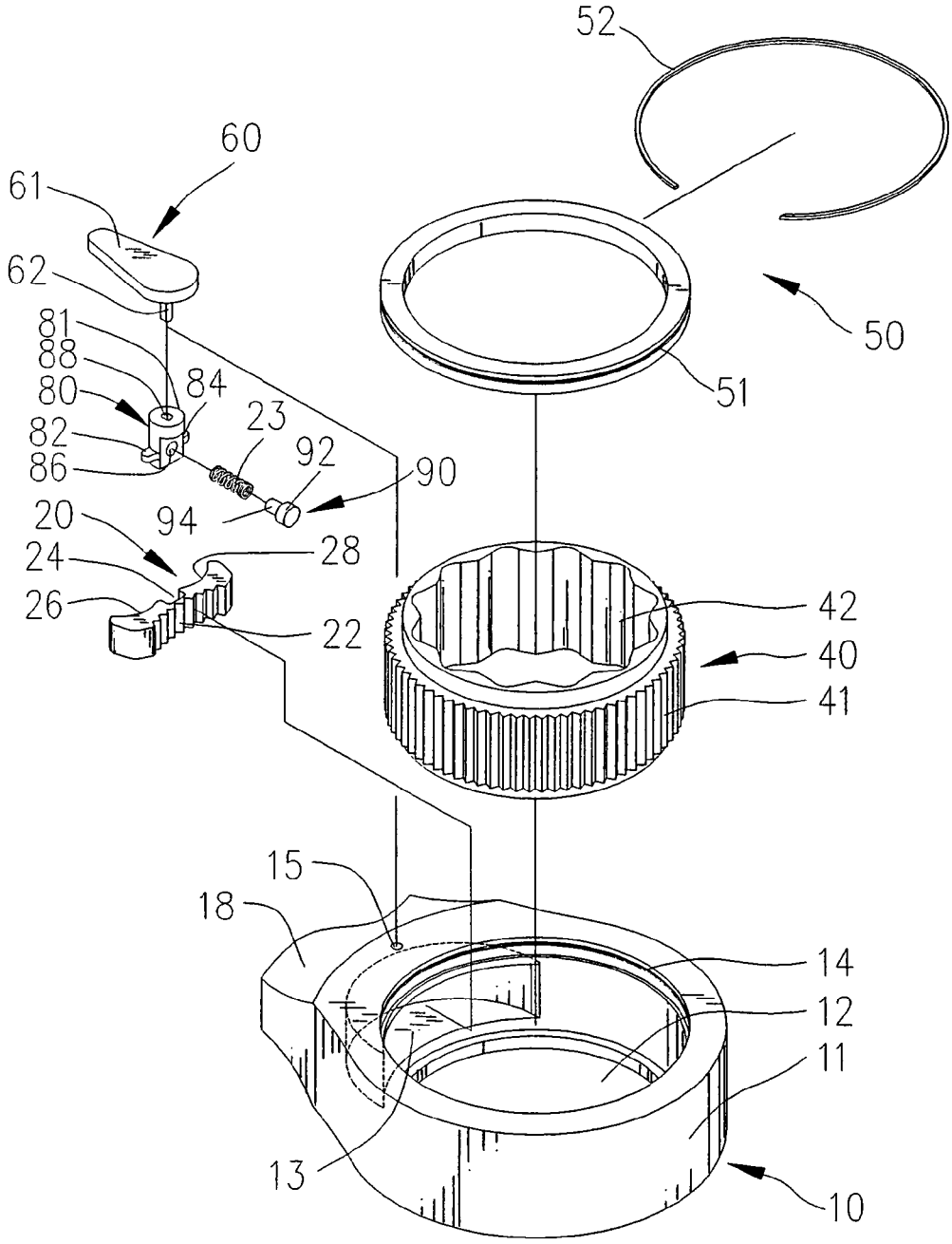
FIG. 7 is an exploded view of the selective one-way wrench shown in FIG. 6.
Figure 8:
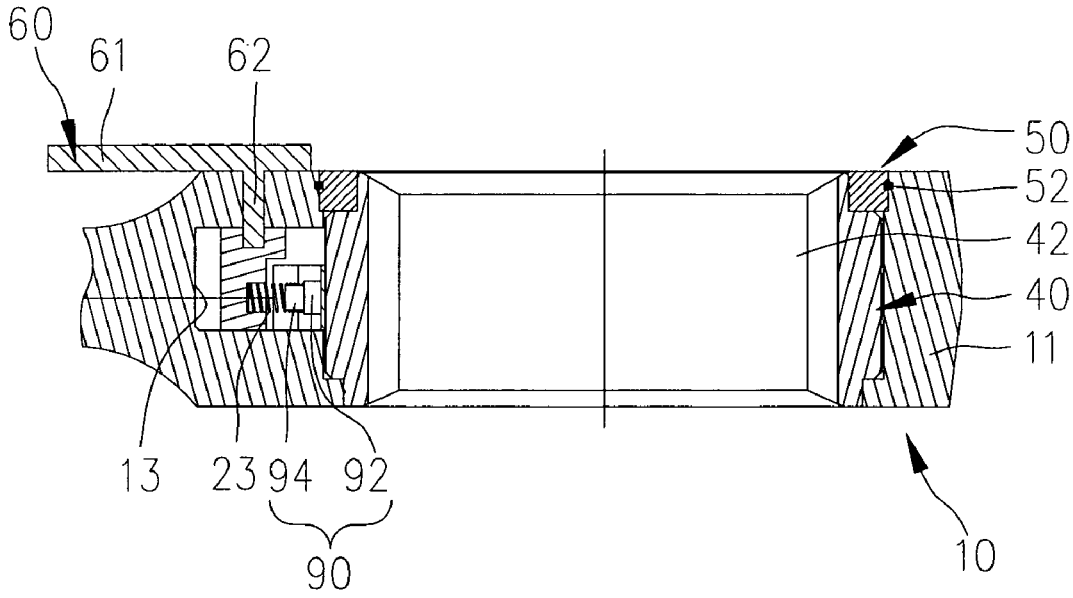
FIG. 8 is a cross-sectional view of the selective one-way wrench of FIG. 6.

FIGS. 6 to 8 show a selective one-way wrench according to a second embodiment of the present invention. The second embodiment is identical to the first embodiment except for including a switch 60 instead of the switch 30, for excluding the annular groove 16 and for including an additional detent 90. The switch 60 does not include any shaft and its tongue 62 is longer than the tongue 33 of the switch 30. The detent 90 includes a head 92 and a plug 94. The head 92 is inserted in the recess 24 of the pawl 20. The plug 94 is fit in an end of the spring 23.

Figure 9:
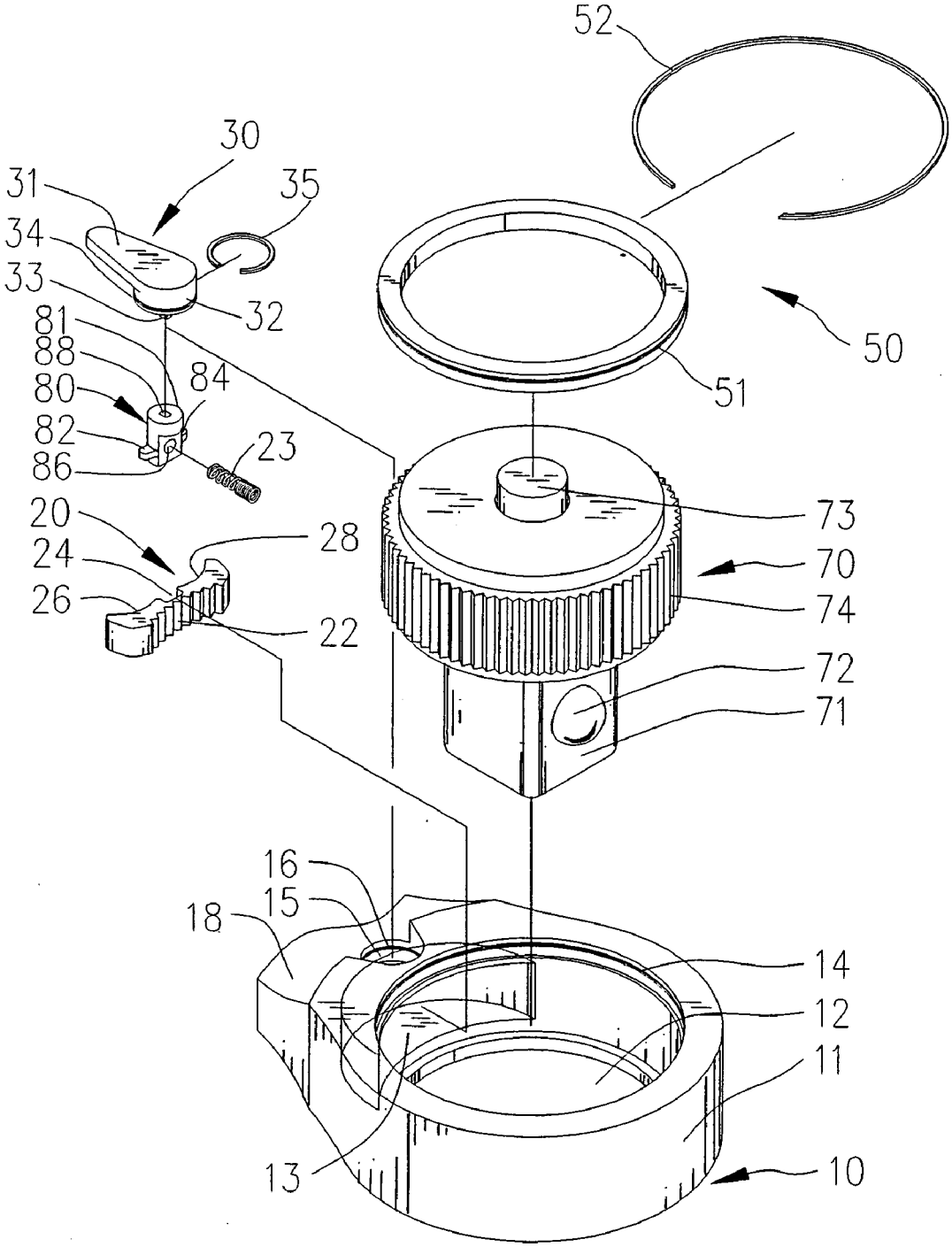
FIG. 9 is an exploded view of a selective one-way wrench according to a third embodiment of the present invention.
Figure 10:
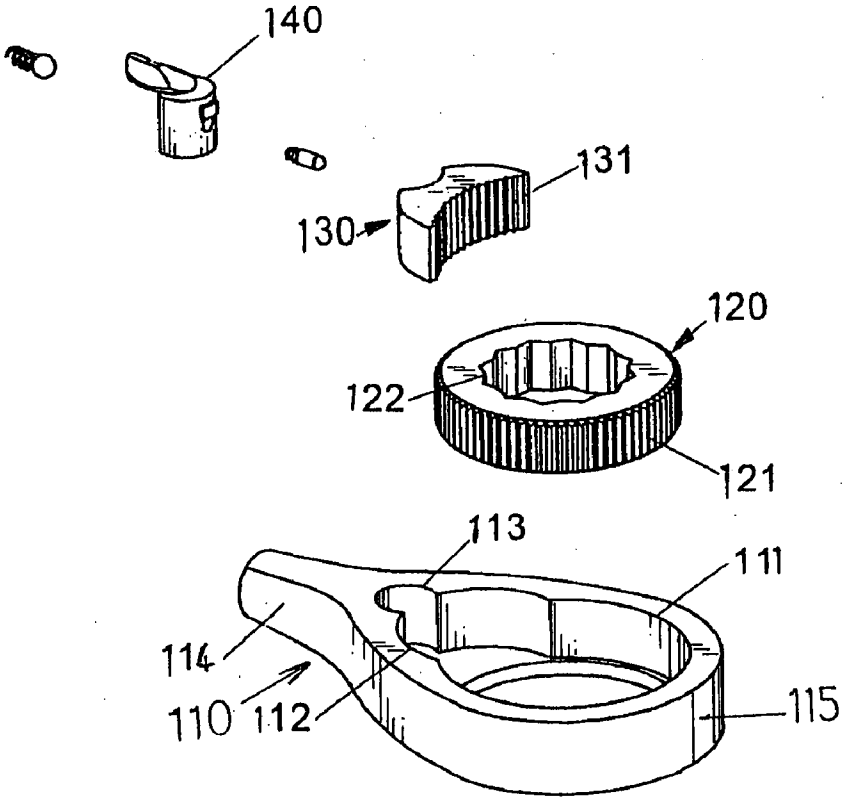
Fig. 10 PRIOR ART
FIG. 10 is an exploded view of a conventional selective one-way wrench.

FIG. 9 shows a selective one-way wrench according to a third embodiment of the present invention. The third embodiment is identical to the first embodiment except for replacing the annular gear 40 with a joint 70. The joint 70 includes a hollow insert 71, a detent 72 movably put in the hollow insert 71 and a control element 73 movably put in the hollow insert 71 for pushing the detent 72 from the hollow insert 71.

The present invention has been described through detailed illustration of three embodiments. Those skilled in the art can derive variation from the embodiments without departing from the scope of the present invention. Therefore, the embodiments shall not limit the scope of the present invention defined in the claims.

What is claimed is:

1. A selective one-way wrench comprising:

an annular head defining a first space, a second space communicated with the first space and an aperture communicated with the second space;

a gear rotationally put in the first space, the gear including a toothed face;

a pawl put in the second space, the pawl including a toothed face engaged with the toothed face of the gear and two concave faces;

a transmission rotationally put in the second space, the transmission including two wings selective one of which is in contact with corresponding one of the concave faces of the pawl;

a switch put into the second space through the aperture for connection with the transmission; and a spring connected between the pawl and the transmission.

2. The selective one-way wrench according to claim 1 wherein the switch includes a lever that is operable for the rotation thereof.

3. The selective one-way wrench according to claim 1 wherein the switch includes a tongue, and the transmission defines a recess in order to receive the tongue.

4. The selective one-way wrench according to claim 3 wherein the switch further includes a shaft from which the tongue projects from the shaft.

5. The selective one-way wrench according to claim 1 wherein the pawl defines a recess in order to receive en end of the spring.

6. The selective one-way wrench according to claim 1 wherein the transmission defines a hole in order to receive an end of the spring.

7. The selective one-way wrench according to claim 1 wherein the spring is a compression spring.

8. The selective one-way wrench according to claim 1 including a C-ring, wherein the switch defines an annular groove in an external side for receiving an internal edge of the C-ring, and the annular head defines an annular groove in a wall of the aperture for receiving an external edge of the C-ring.

9. The selective one-way wrench according to claim 1 wherein the gear is an annular gear.

10. The selective one-way wrench according to claim 1 wherein the gear includes an insert for insertion in and rotation of a socket.

11. The selective one-way wrench according to claim 1 including a handle projecting from the annular head.

12. The selective one-way wrench according to claim 1 including a detent located between the pawl and the spring.

13. The selective one-way wrench according to claim 12 wherein the detent includes a head and a plug extending from the head.

14. The selective one-way wrench according to claim 13 wherein the head of the detent is put in the recess.

15. The selective one-way wrench according to claim 13 wherein the plug of the detent is put in the spring.

16. The selective one-way wrench according to claim 1 wherein the gear is an annular gear.

17. The selective one-way wrench according to claim 1 wherein the gear includes an insert for insertion in and rotation of a socket.

18. The selective one-way wrench according to claim 1 including a handle projecting from the annular head.

* * * * *